US011574778B2

(12) United States Patent
Huang et al.

(10) Patent No.: US 11,574,778 B2
(45) **Date of Patent: *Feb. 7, 2023**

(54) ILLUMINATED KEYSWITCH STRUCTURE AND ILLUMINATING MODULE THEREOF

(71) Applicant: Darfon Electronics Corp., Taoyuan (TW)

(72) Inventors: Heng-Yi Huang, Taoyuan (TW); Hsin-Cheng Ho, Taoyuan (TW); Yuan-Bao Chen, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/810,879

(22) Filed: Jul. 6, 2022

(65) Prior Publication Data

US 2022/0351921 A1 Nov. 3, 2022

Related U.S. Application Data

(63) Continuation of application No. 17/234,808, filed on Apr. 20, 2021.

(30) Foreign Application Priority Data

Jan. 5, 2021 (TW) ..... 110100264

(51) Int. Cl.
*H01H 13/02* (2006.01)
*H01H 13/14* (2006.01)
(Continued)

(52) U.S. Cl.
CPC ..... *H01H 13/023* (2013.01); *H01H 13/04* (2013.01); *H01H 13/14* (2013.01); *H01H 13/52* (2013.01)

(58) Field of Classification Search
CPC ..... H01H 13/023; H01H 13/04; H01H 13/14; H01H 13/52; H01H 2219/036;
(Continued)

(56) References Cited

U.S. PATENT DOCUMENTS 5,138,118 A 8/1992 Russell
5,138,119 A * 8/1992 Demeo ..... H01H 13/702 200/512
(Continued)

FOREIGN PATENT DOCUMENTS

CN 101577260 B 1/2011
CN 202871650 U 4/2013
(Continued)

OTHER PUBLICATIONS

Non-Final Office Action issued in U.S. Appl. No. 17/510,597, filed Oct. 26, 2021, dated Jul. 7, 2022.
Delilah Lin, Fubo Liang of LatticePower-No support will be the trend of CSP, www.ledinside.com.tw/interview/20171227-34868.html, LEDinside ofTrendForce, Dec. 27, 2017.
(Continued)

*Primary Examiner* — Lheiren Mae A Caroc
(74) *Attorney, Agent, or Firm* — McClure, Qualey & Rodack, LLP

(57) ABSTRACT

An illuminated keyswitch structure with an illuminating module includes a base plate, a drive circuit board under the base plate, a spacer between the drive circuit board and the base plate, and a light-emitting part on the circuit board. The spacer has a through hole communicating with an opening of the base plate in a vertical direction. The light-emitting part is located in the through hole, and falls within a projection of the opening in the vertical direction. The light-emitting part has a top surface that is lower than or equal to a bottom surface of the base plate in the vertical direction. The structure of the illuminated keyswitch structure around the
(Continued)

light-emitting part can keep flat by the spacer. The spacer can prevent the light-emitting part from structurally entering the opening, avoiding structural interference between the light-emitting part and other components above the base plate.

20 Claims, 10 Drawing Sheets

(51) Int. Cl.
*H01H 13/04* (2006.01)
*H01H 13/52* (2006.01)

(58) Field of Classification Search
CPC ..... H01H 2219/04; H01H 2219/056; H01H 13/83; H01H 3/125; H01H 3/12; H01H 13/70; H01H 13/702; H01H 13/703; H01H 13/704; H01H 13/705; H01H 2219/054; H01H 2219/062; H01H 2227/002; H01H 2227/006; H01H 2227/01; H01H 2227/024; H01H 13/02
See application file for complete search history.

(56) References Cited

U.S. PATENT DOCUMENTS

| | | | | |
|---|---|---|---|---|
| 8,383,972 | B2 | 2/2013 | Liu | |
| 10,056,206 | B2 * | 8/2018 | Chen | H01H 13/704 |
| 2013/0271948 | A1 | 10/2013 | Chang et al. | |
| 2019/0228930 | A1 * | 7/2019 | Lin | G02B 6/0011 |
| 2020/0301523 | A1 | 9/2020 | Ho et al. | |
| 2020/0301524 | A1 | 9/2020 | Ho et al. | |
| 2021/0012984 | A1 * | 1/2021 | Chen | H01H 13/83 |
| 2022/0216018 | A1 * | 7/2022 | Huang | H01H 13/04 |
| 2022/0336167 | A1 * | 10/2022 | Huang | H01H 13/83 |

FOREIGN PATENT DOCUMENTS

| | | | |
|---|---|---|---|
| CN | 206921733 | U | 1/2018 |
| JP | 4926789 | B2 | 5/2012 |
| TW | 202871650 | A | 4/2017 |

OTHER PUBLICATIONS

Delilah Lin, What have these five packaging companies done to CSP LED, www.ledinside.com.tw/news/20170216-33796.html, LEDinside of Trend Force, Feb. 16, 2017.

* cited by examiner

ILLUMINATED KEYSWITCH STRUCTURE AND ILLUMINATING MODULE THEREOF

CROSS REFERENCE TO RELATED APPLICATIONS

This application is a continuation of U.S. application Ser. No. 17/234,808, filed on Apr. 20, 2021, which claims the benefit of Taiwan patent application No. 110100264, filed on Jan. 5, 2021, which applications are hereby incorporated herein by reference in their entirety.

BACKGROUND OF THE INVENTION

1. Field of the Invention

The present invention relates to a keyswitch structure, and more particularly to an illuminated keyswitch structure and an illuminating module thereof.

2. Description of the Prior Art

Some illuminated keyswitch structures on the market are equipped with an exclusive light source under the base plate to emit light upward. The base plate forms an opening corresponding to the light source so that the light can pass through the base plate. Generally, in order to avoid electrostatic discharges between the base plate and the light source and protect the light source, an insulation sheet is attached onto the light source and a circuit board on which the light source is disposed. In principle, the light source protrudes from the circuit board, so that the insulation sheet as a whole is a convex structure. The convex structure will make the portion of the illuminated key switch structure near the light source appear uneven, which is not conducive to the assembly of the components of the illuminated key switch structure and the overall thin design of the illuminated keyswitch structure. Furthermore, the convex insulation sheet will enter the opening of the base plate, and even the light source will also partially enter the opening. This structural configuration will increase the chance of structural interference with the structural parts above the base plate (e.g. the supports supporting the keycap), causing the keycap to fail to move up and down smoothly, or indirectly damage the light source.

SUMMARY OF THE INVENTION

An objective of the invention is to provide an illuminated keyswitch structure and an illuminating module, which uses a flat spacer to separate a base plate and a light-emitting part thereof. This structural configuration helps to control the size of the structure, ensure the distance for mixing light, and protect the light-emitting part, which prevents the light-emitting part from structurally interfering with other components above the bottom plate and causing damage.

An illuminated keyswitch structure according to an embodiment of the invention comprises: abase plate, including at least one opening; a drive circuit board, disposed under the base plate; a spacer, disposed onto the drive circuit board, the spacer having an upper surface, a lower surface, a through hole and a sidewall defining the through hole; a light-emitting part, disposed on the drive circuit board and in the through hole of the spacer, the light-emitting part having a top surface lower than or equal to the upper surface of the spacer; and a light-permeable covering structure covering above the light-emitting part; wherein the spacer comprises a top adhesive and a bottom adhesive respectively disposed on the upper surface and the lower surface of the spacer. In an variant embodiment, an illuminating module for providing back light from underneath an opening of a keyswitch base plate is introduced, which comprises the aforesaid drive circuit board, the spacer, the light-emitting part, the light-permeable covering structure, the top adhesive and bottom adhesive; wherein a total thickness of the spacer, the top adhesive, and the bottom adhesive is greater than or equal to a sum of a height of the light-emitting part and a thickness of a portion of the light-permeable covering structure above the light-emitting part. In another embodiment, the upper surface or the lower surface has an annular clearance fringe without the top adhesive or the bottom adhesive respectively, and the annular clearance fringe surrounds the periphery of the through hole. In another derived embodiment, a sum of a height of the sidewall of the through hole and thicknesses of the top adhesive and the bottom adhesive is greater than or equal to a sum of a height of the light-emitting part and a thickness of a portion of the light-permeable covering structure above the light-emitting part. Thereby, through the spacer, the structure of the illuminated keyswitch structure around the light-emitting part can keep flat, which is conducive to the control on the structural size. The spacer can prevent the light-emitting part from structurally entering the opening of the base plate, which can prevent the light-emitting part from structurally interfering with other components above the bottom plate in the illuminated key structure and causing damage.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
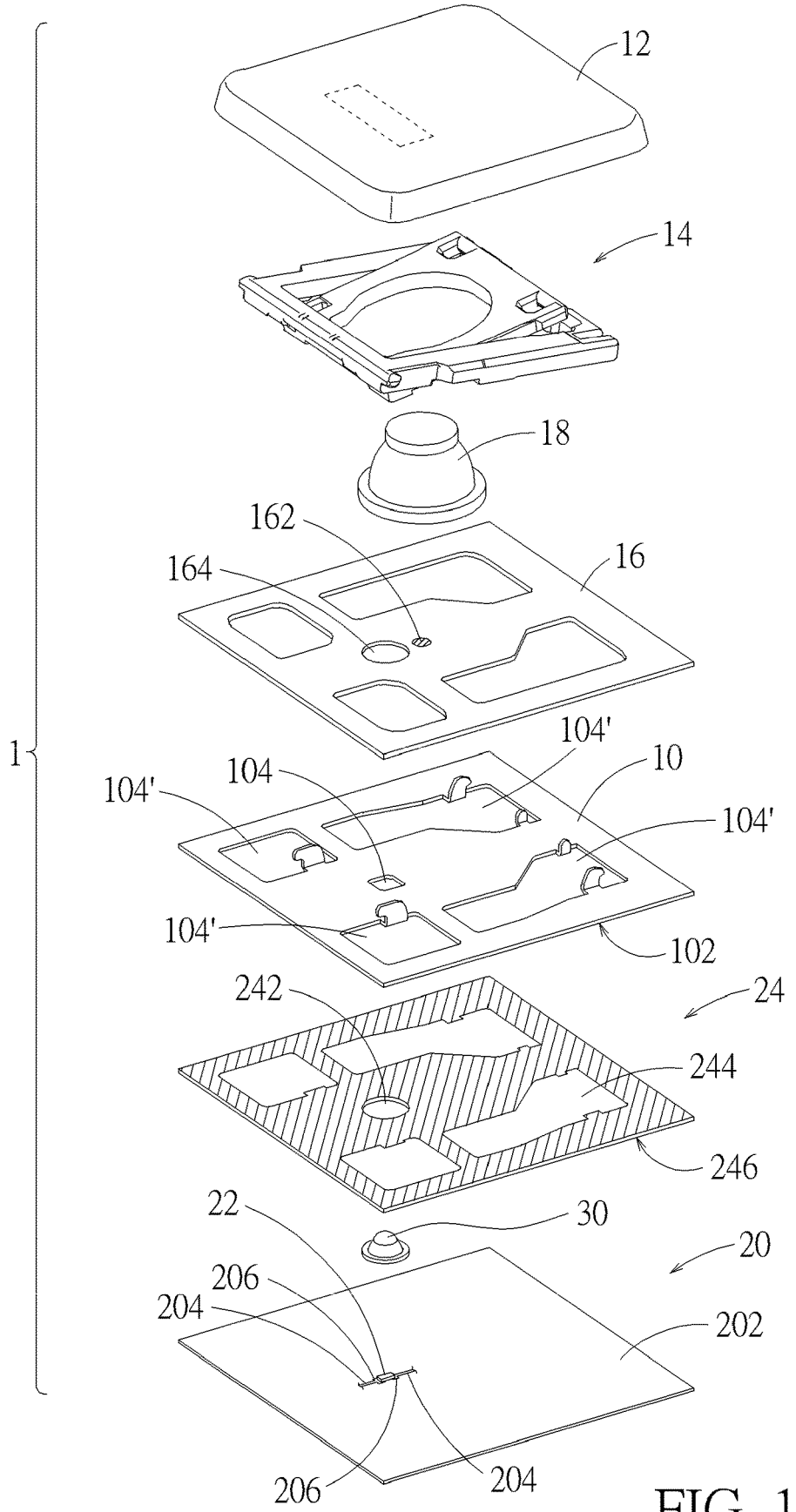
FIG. 1 is an exploded view of an illuminated keyswitch structure according to an embodiment.
Figure 2:
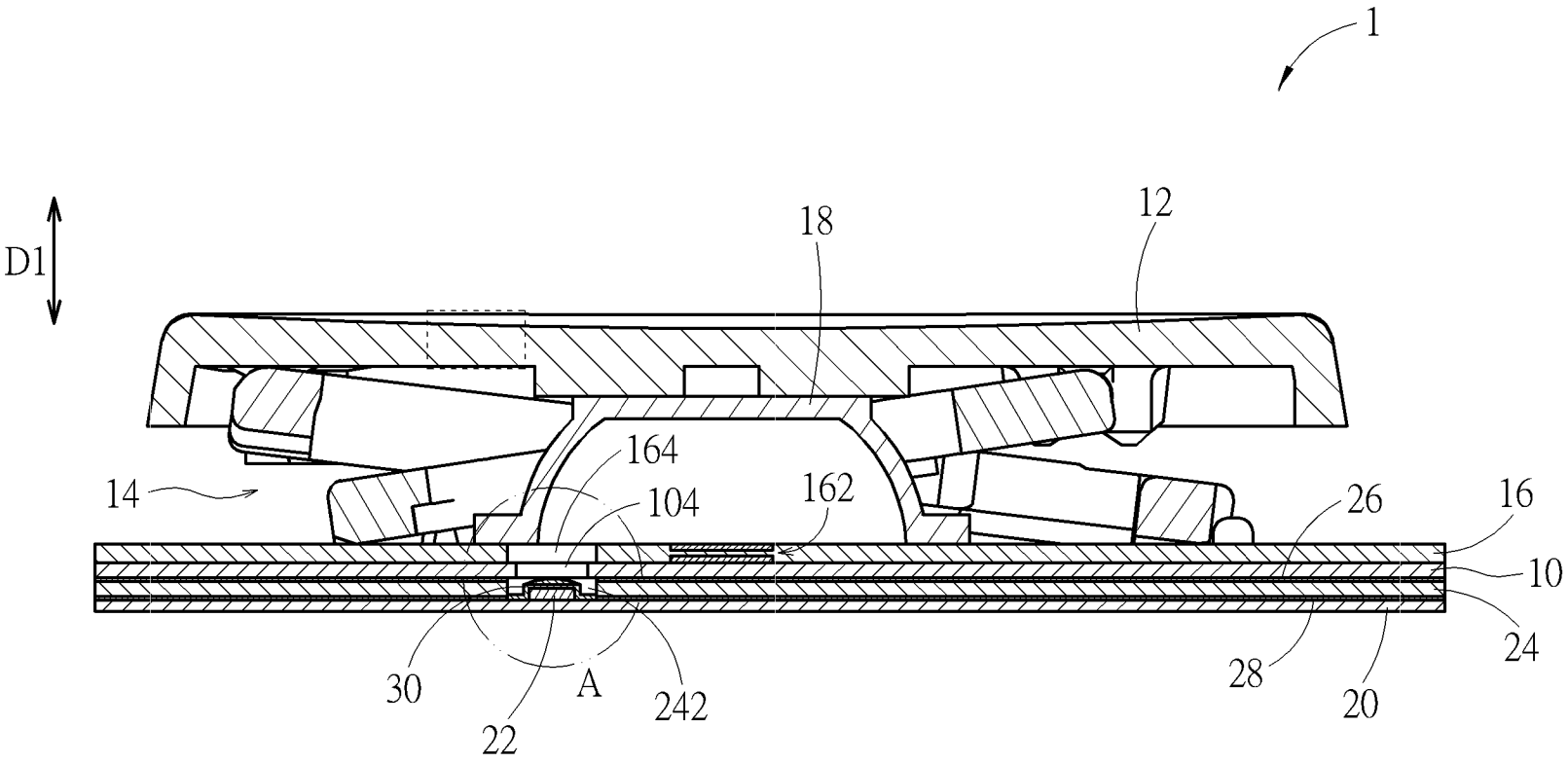
FIG. 2 is a sectional view of the illuminated keyswitch structure in FIG. 1.
Figure 3:
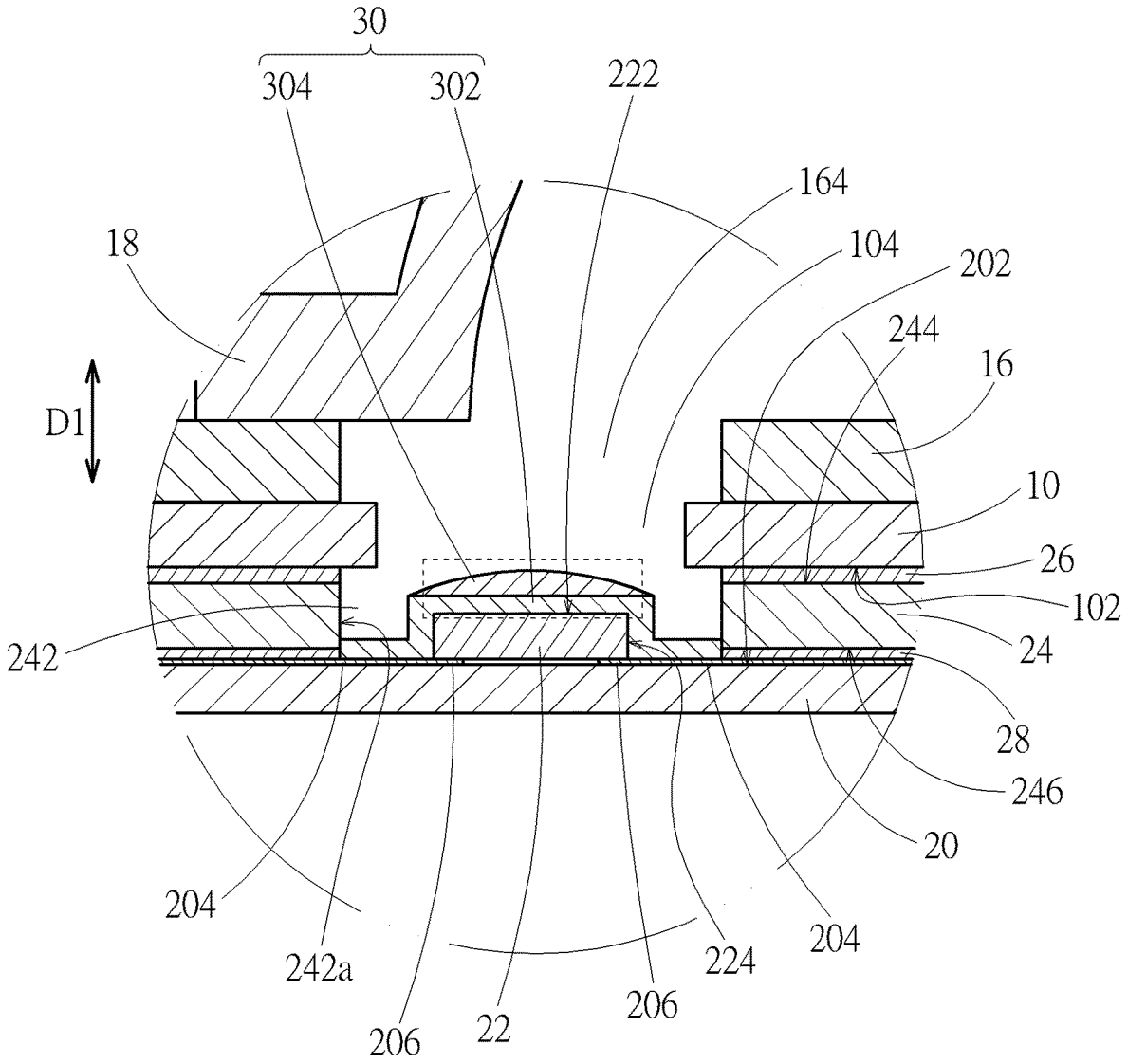
FIG. 3 is an enlarged view of the circle A in FIG. 2.

Please refer to FIG. 1 to FIG. 3. An illuminated keyswitch structure 1 according to an embodiment includes a base plate 10, a keycap 12, a lift mechanism 14, a switch circuit board 16, a resilient restoration part 18, a drive circuit board 20, a light-emitting part 22, and a spacer 24. The keycap 12 is disposed above the base plate 10. The lift mechanism 14 is connected to and between the base plate 10 and the keycap 12, so that the keycap 12 can move up and down relative to the base plate 10 through the lift mechanism 14. The switch circuit board 16 is disposed on the base plate 10 and has a switch 162 (indicated by a hatched circle in FIG. 1). The resilient restoration part 18 is disposed between the keycap 12 and the switch 162 corresponding to the switch 162. The keycap 12 can be pressed down to squeeze the resilient restoration part 18, so that the resilient restoration part 18 triggers the switch 162. The switch 162 can be triggered by a triggering protrusion located above the switch circuit board 16. The triggering protrusion extends from any of components above the switch circuit board 16, including the resilient restoration part 18, the lift mechanism 14, the keycap 12, and so on. When the keycap 12 is no longer pressed, the keycap 12 is moved upward to its original position by the resilience of the resilient restoration part 18. Therein, the lift mechanism 14 is achieved by a scissors support, which includes two supports that are individually connected to and between the base plate 10 and the keycap 12 and pivotally connected with each other. The switch circuit board 16 is achieved by a membrane circuit board, which includes an upper circuitry carry plate, a lower circuitry carry plate, and an intermediate insulation plate between the upper circuitry carry plate and the lower circuitry carry plate. The switch is formed by circuitry contacts oppositely disposed on the upper circuitry carry plate and the lower circuitry carry plate. The resilient restoration part 18 may be achieved by, for example, but not limited to rubber domes.

In practice, the lift mechanism 14, the switch circuit board 16, and the resilient restoration part 18 may be achieved by other structures capable of producing the same effect. For example, the lift mechanism 14 may be achieved by a butterfly support or other me4chanisms capable of moving the keycap up and down. In practice, the lift mechanism for long keycaps (e.g. space bar, enter/return key, backspace key, shift key, and so on) may be achieved by multiple scissors supports, butterfly supports, or a combination thereof. For another example, the switch circuit board 16 may be achieved by a circuit board with a tactile switch. For another example, the switch circuit board 16 may be achieved by a printed circuit board or a flexible circuit board, on which two adjacent contacts are formed as the switch 162. The resilient restoration part 18 has a conductive portion corresponding to the two contacts and can simultaneously touch the two contacts through the conductive portion to achieve the triggering of the switch 162. For another example, the resilient restoration part 18 may be achieved by a spring or other elastic structures.

Furthermore, in the embodiment, the drive circuit board 20 is disposed under the base plate 10 and has an upper surface 202. The light-emitting part 22 is electrically disposed on the upper surface 202 of the drive circuit board 20. The light-emitting part 22 may be a single monochromatic light-emitting diode (e.g., white), or multiple light-emitting diodes of different colors (e.g., red, green, and blue). The spacer 24 is disposed between the base plate 10 and the drive circuit board 20. The base plate 10 has a bottom surface 102 and one or more openings 104 and 104'. The switch circuit board 16 has a through hole 164. The spacer 24 has a through hole 242. The opening 104 of the base plate 10, the through hole 164 of the switch circuit board 16, and the through hole 242 of the spacer 24 are communicated in a vertical direction D1 (indicated by a double-headed arrow in the figures). The projections of the above three in the vertical direction D1 can be completely aligned, or at least partially overlap. That is, the opening 104, the through hole 164, and the through hole 242 in the vertical direction D1 at least partially overlap, so that in the vertical direction D1, there is a straight channel passing through the opening 104, the through hole 164, and the through hole 242. In other instances, the switch circuit board 16 is light-transmissive except for the circuitry of the switch circuit board 16, and the through hole 164 is not absolutely necessary. The light-emitting part 22 has a top surface 222 located in the through hole 242. The top surface 222 is lower in height than the bottom surface 102 of the base plate 10. Thereby, the structure of the illuminated keyswitch structure 1 around the light-emitting part 22 can keep flat, which helps to control the size of the structure. Furthermore, in other instances, the light-emitting part 22 and the through hole 242 may be located corresponding to other openings 104' of the base plate 10. For multiple-width keys of larger size or keys that need one more indication light source, multiple light-emitting parts 22 may be located corresponding to the different openings 104 and 104' of the base plates 10 respectively.

The spacer 24 can also prevent the light-emitting part 22 form structurally entering the opening 104 of the base plate 10, which can prevent the light-emitting part 22 from structurally interfering with other components (e.g., temporarily enter the opening 104 due to the movement thereof) above the bottom plate 10 in the illuminated key structure 1 and causing damage. In addition, in the embodiment, the spacer 24 is plate-shaped and has a profile equivalent to that of the drive circuit board 20. This structural configuration helps the base plate 10, drive circuit board 20 and spacer 24 to keep flat; however, it is not limited thereto. For example, the spacer 24 is ring-shaped (e.g., circle, square, or other geometric shapes) and surrounds the light-emitting part 22, which still can make the structure of the illuminated keyswitch structure 1 around the light-emitting part 22 keep flat. In addition, in practice, the switch circuit board 16 may be disposed under the base plate 10 and structurally integrated with the drive circuit board 20 into a single circuit board. For example, with removing the switch circuit board 16, a tactile switch is disposed on the drive circuit board 20 corresponding to the triggering protrusion that extends from any of the resilient restoration part 18, the lift mechanism 14, and the keycap 12. The base plate 10 forms an opening correspondingly, so that the resilient restoration part 18 can move downward to touch the tactile switch.

In the embodiment, the sidewall 242*a* of the through hole 242 of the spacer 24 surrounds the light-emitting part 22 and is close enough to the side surfaces of the light-emitting part 22. The top edge of the sidewall 242*a* is higher than the light-emitting part 22, protecting the light-emitting part 22. Therefore, regardless of whether the light-emitting part 22 is covered by insulation material, the light-emitting part 22 can be protected from interference and collision during assembly or operation. Moreover, the sidewall 242*a* of the through hole 242 is opaque, so that light emitted by the light-emitting part 22 will not enter the spacer 24, which can avoid unintended a side leakage of light from the periphery of the keyswitch or keyboard. In practice, when the spacer 24 is made of light-transmissive materials, the sidewall 242*a* can be coated with an opaque layer. Moreover, the spacer 24 can be made directly of opaque materials, so that the entire spacer 24 is opaque. Furthermore, in the embodiment, the through hole 242 of the spacer 24 is larger than the opening 104 of the base plate 10 (e.g., in the vertical direction D1, the projection of the opening 104 is located within the projection of the through hole 242, and the light-emitting part 22 is located with the projection of the opening 104), which helps to prevent the light reflected by the through hole 242 and the sidewall 242*a* from being directly emitted from the opening 104. Moreover, the through hole 164 of the switch circuit board 16 is larger than the opening 104 of the base plate 10 (e.g., in the vertical direction D1, the projection of the opening 104 is located within the projection of the through hole 164), which helps to reduce the entry of the light emitted from the opening 104 into the switch circuit board 16 from the sidewall of the through hole 164. In other instances, as long as the two projections at least partially overlap in the vertical direction D1, and the light-emitting part 22 completely falls within the projections of the openings 104 and 104' of the base plate 10 in the vertical direction D1 and is not covered directly by the base plate 10, the sizes of the openings 104 and 104' of the base plate 10 are not necessarily smaller than the size of through hole 242 of the spacer 24.

Furthermore, in the embodiment, the illuminated keyswitch structure 1 includes a top adhesive 26 and a bottom adhesive 28 (which are not shown in FIG. 1 for drawing simplification), through which the spacer 24 is combined with the base plate 10 and the drive circuit board 20 respectively. Therein, the spacer 24 has an upper surface 244 and a lower surface 246 opposite to the upper surface 244. The top adhesive 26 is disposed between the upper surface 244 and the bottom surface 102 of the base plate 10. The top adhesive 26 avoids all openings 104 and 104' of the base plate 10. The spacer 24 is fixedly connected to the base plate 10 through the top adhesive 26 (i.e., the top adhesive 26 adheres to the upper surface 244 and the bottom surface 102 of the base plate 10). The bottom adhesive 28 is disposed between the lower surface 246 and the upper surface 202 of the drive circuit board 20. The spacer 24 is fixedly connected to the drive circuit board 20 through the bottom adhesive 28 (i.e., the bottom adhesive 28 adheres to the lower surface 246 and the upper surface 202 of the drive circuit board 20). In addition, the top adhesive 26 and the bottom adhesive 28 may be made of opaque materials in practice, which can prevent light from entering the top adhesive 26 and the bottom adhesive 28.

In practice, the spacer 24 may first be coated with the top adhesive 26 and the bottom adhesive 28 on the upper surface 244 and the lower surface 246 respectively. Then, the spacer 24 is bonded to the drive circuit board 20 with the bottom adhesive 28; finally, the spacer 24 is bonded to the base plate 10 with the top adhesive 26. In general, the top adhesive 26 and the bottom adhesive 28 will not overflow into the through hole 242 of the spacer 24 and contact the sidewall 242*a* of the through hole 242 or the light-emitting part 22. In the embodiment, the coverage of the top adhesive 26 on the upper surface 244 is shown as the hatched area in FIG. 1, and is equivalent to the projection area of the base plate 10 on the upper surface 244. After the bonding, the top adhesive 26 will not be exposed; that is, the base plate 10 and the spacer 24 can completely cover the top adhesive 26. Moreover, in the vertical direction D1, the projection of the lower surface 246 of the spacer 24 is completely within the upper surface 202 of the drive circuit board 20, so the entire lower surface 246 of the spacer 24 corresponding to the area other than the light-emitting part 22, or the entire lower surface 246 of the spacer 24 except for the through hole 242 is coated with the bottom adhesive 28. Similarly, after the bonding, the bottom adhesive 28 will not be exposed; that is, the drive circuit board 20 and the spacer 24 can completely cover the bottom adhesive 28. However, it is not limited thereto in practice. Furthermore, in an instance shown by FIG. 4, the top adhesive 26' (of which the thickness is exaggeratedly shown in the figures) coats the upper surface 244 of spacer 24 in a grid. Therein, after the bonding, the top adhesive 26' is still completely covered by the base plate 10. In practice, the pattern of the grid is not limited to that shown in FIG. 4. The grid coating can increase the tolerance for the coating of the top adhesive 26', which can prevent the top adhesive 26' from overflowing from between the spacer 24 and the base plate 10 and interfering with the movement (e.g., touching the supports of the lift mechanism 14) or assembly (e.g., touching an outer casing (not shown in the figures) of the illuminated keyswitch structure 1) of other components.

Figure 4:
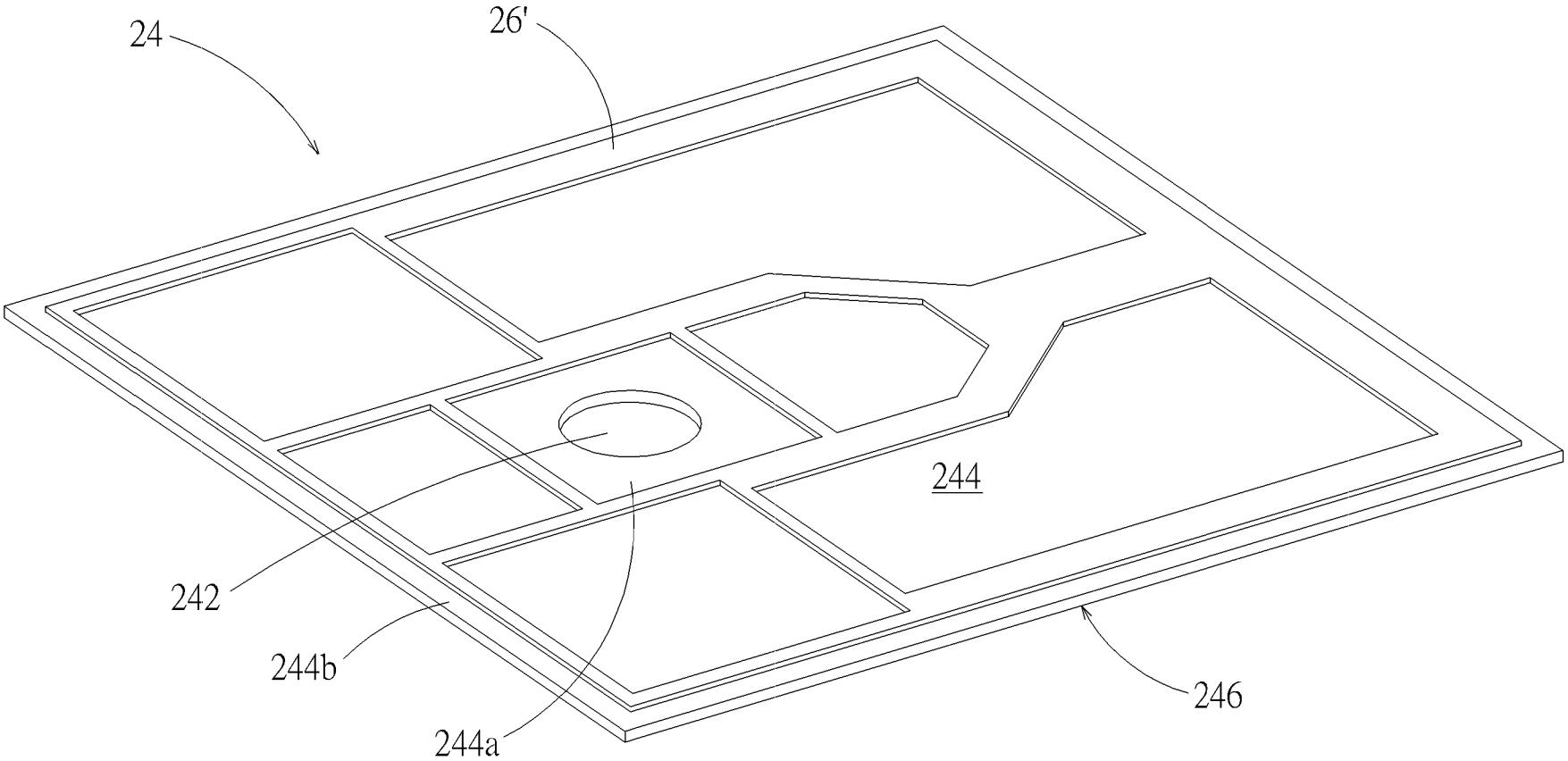
FIG. 4 is a schematic diagram illustrating the coverage of a top adhesive on the spacer in an instance.
Figure 5:
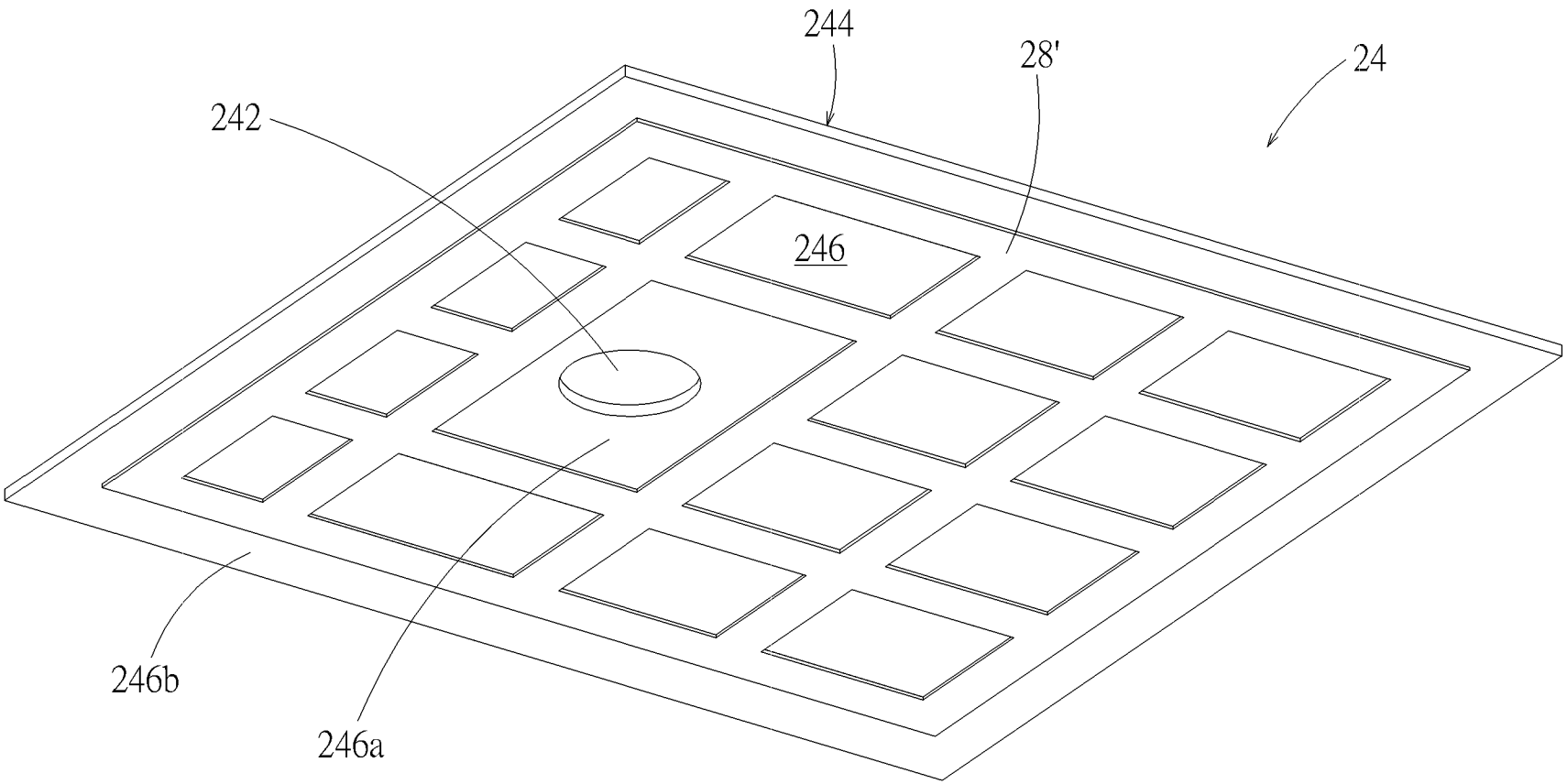
FIG. 5 is a schematic diagram illustrating the coverage of a bottom adhesive on the spacer in an instance.

Furthermore, as shown by FIG. 4, the upper surface 244 has an annular clearance fringe 244*a*, surrounding the periphery of the through hole 242. There is no top adhesive 26' is on the annular clearance fringe 244*a*, which can prevent the top adhesive 26' from overflowing from between the spacer 24 and the base plate 10 and entering the through hole 242 of the spacer 24 or the opening 104 of the base plate 10. Moreover, the upper surface 244 has an outer clearance fringe 244*b*. There is no top adhesive 26' on the outer clearance fringe 244*b*, which can prevent the top adhesive 26' from overflowing outward from between the spacer 24 and the base plate 10. Similarly, in an instance shown by FIG. 5, the bottom adhesive 28' (of which the thickness is exaggeratedly shown in the figures) is coated on the lower surface 246 of spacer 24 in a grid. The lower surface 246 has an annular clearance fringe 246*a* and an outer clearance fringe 246*b*. The annular clearance fringe 246*a* surrounds the periphery of the through hole 242. There is no bottom adhesive 28' on the annular clearance fringe 246*a* and also on the outer clearance fringe 246*b*. The grid coating of the bottom adhesive 28' also has the same effect as the grid coating of the top adhesive 26' and will not be repeated herein. In addition, in practice, the top adhesive and the bottom adhesive can also coat on the upper surface 244 and the lower surface 246 of the spacer 24 in discrete dots, which also can bond the space 24 to the base plate 10 and the drive circuit board 20. Furthermore, for the thinning trend of illuminated keyswitch structures, the distance between the light-emitting part 22 and the keycap 12 is designed to be gradually reduced. When the light-emitting part 22 is a combination of multiple light-emitting diodes of different colors, for white light or a specific color light, since the distance between the light-emitting part 22 and the keycap 12 becomes smaller, the light mixing distance may be insufficient. Therefore, adjusting the thickness of the spacer 24 or the total thickness of the spacer 24, the top adhesive 26(26'), and the bottom adhesive 28(28') helps to adjust the light mixing distance, so that light of various colors emitted by the light-emitting part 22 can have enough distance to mix to be a required target color light before passing through the keycap 12. For the protection effect on the light-emitting part 22, the total thickness of the spacer 24, the top adhesive 26(26'), and the bottom adhesive 28(28') (calculated from the top surface of the drive circuit board 20, the same below), or the sum of the height of the sidewall 242*a* of the through hole 242 and the thicknesses of the top adhesive 26(26') and the bottom adhesive 28(28') is required to be greater than or equal to the height of the light-emitting part 22.

Please refer back to FIG. 1 to FIG. 3. In the embodiment, the illuminated keyswitch structure 1 also includes a light-permeable covering structure 30 that covers the light-emitting part 22. The light-emitting part 22 may be but not limited to a light-emitting diode. The light-emitting part 22 emits light form the top surface 222 (i.e. emitting light upward). The light-emitting part 22 has a side surface 224

(i.e. the sidewall surface that is adjacent to the top surface 222 and surrounds the light-emitting part 22). The light-permeable covering structure 30 covers the top surface 222 and the side surface 224 of the light-emitting part 22 and the upper surface 202 of the drive circuit board 20 at the same time, so that has the effects of modulating the light emitted by the light-emitting part 22 and fixing the light-emitting part 22 on the drive circuit board 20 at the same time. Therein, the structure of the light-permeable covering structure 30 above the top surface 222 can be regarded as a light modulation portion (indicated by a dashed frame in FIG. 3), for modulating the light emitted by the light-emitting part 22. The light modulation portion has an upward convex part, which has a light-converging effect; however, it is not limited thereto. In the embodiment, connection pads 206 of the circuitry 204 of the of the drive circuit board 20 are exposed from the through hole 242 of the spacer 24. The light-emitting part 22 is electrically connected to the connection pads 206. The light-permeable covering structure 30 covers the connection pad 206 and the portion of the circuitry 204 exposed from the through hole 242 at the same time, so that the light-permeable covering structure 30 also has an electrostatic discharge protection effect.

Furthermore, in the embodiment, the highest point of the light-permeable covering structure 30 is substantially equal to the bottom surface 102 of the base plate 10, which prevents the light-permeable covering structure 30 from structurally interfering with other components above the bottom plate 10 in the illuminated key structure 1. The light-permeable covering structure 30 may be designed to be lower than the bottom surface 102. Furthermore, in practice, the light-permeable covering structure 30 may be obtained by dropping glue (e.g. after the spacer 24 is fixed on the drive circuit board 20) or other methods (e.g. by assembling an additional component to the light-emitting part 22). In addition, in practice, the illuminated keyswitch structure 1 can be provided without the light-permeable covering structure 30 covering the light-emitting part 22. In this instance, the top surface 222 of the light-emitting part 22 may be equal to the bottom surface 102 of the base plate 10 in height.

In the embodiment, the light-permeable covering structure 30 includes a first covering layer 302 and a second covering layer 304. The first covering layer 302 is disposed on the top surface 222. The second covering layer 304 is disposed on the first covering layer 302. Therein, the first covering layer 302 covers the top surface 222 and side surface 224 of the light-emitting part 22 and the connection pads 206 at the same time. The second covering layer 304 is disposed on the first covering layer 302 opposite to the top surface 222; however, it is not limited thereto in practice. For example, the second covering layer 304 covers the entire first covering layer 302. Furthermore, in practice, the first covering layer 302 or the second covering layer 304 may be an optical wavelength conversion layer, e.g., but not limited to including phosphors, quantum dots. In addition, the light-permeable covering structure 30 may be a single-layer structure or a multi-layer structure in practice.

Figure 6:
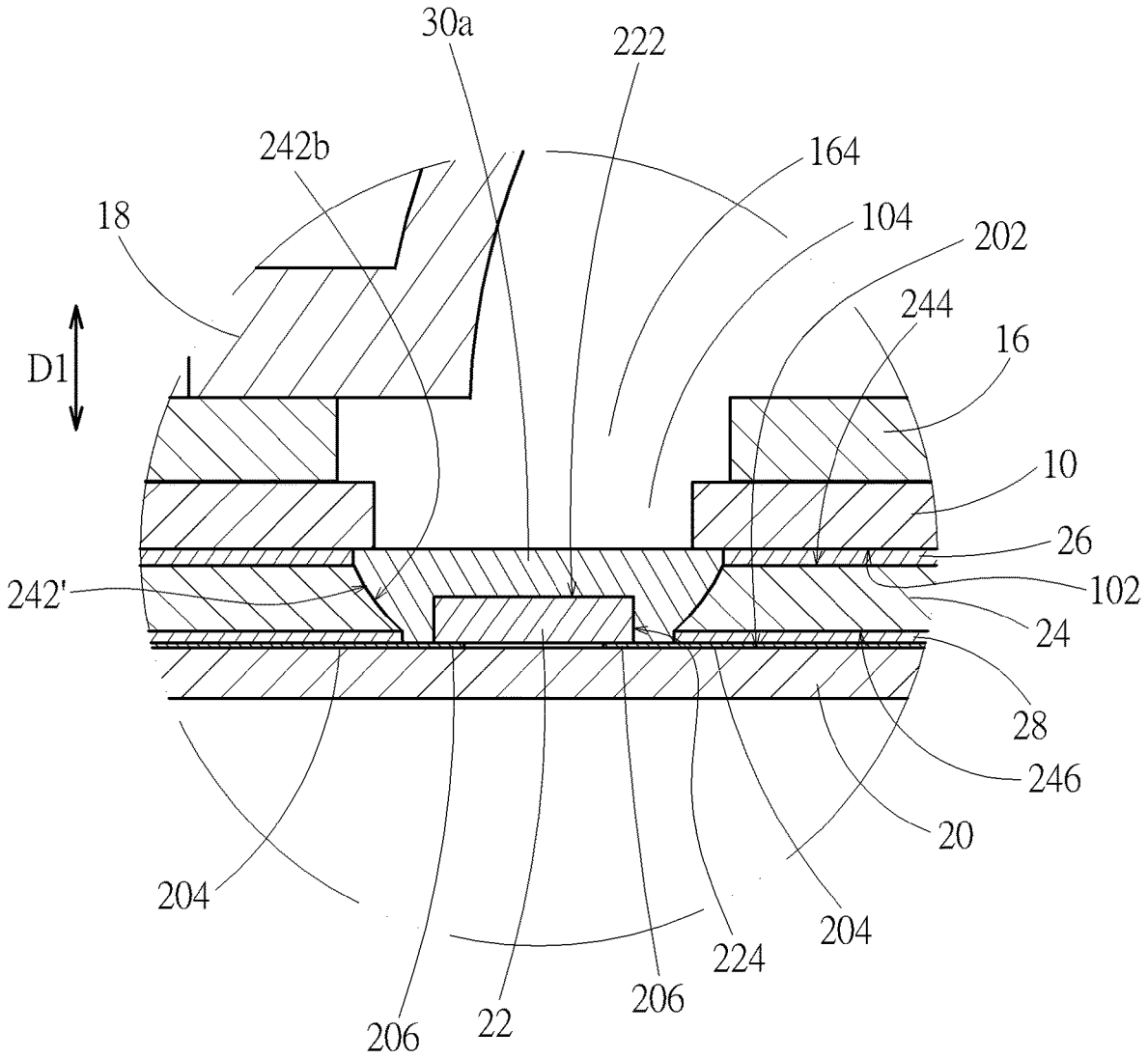
FIG. 6 is a sectional view of the through hole of the spacer in an instance.
Figure 7:
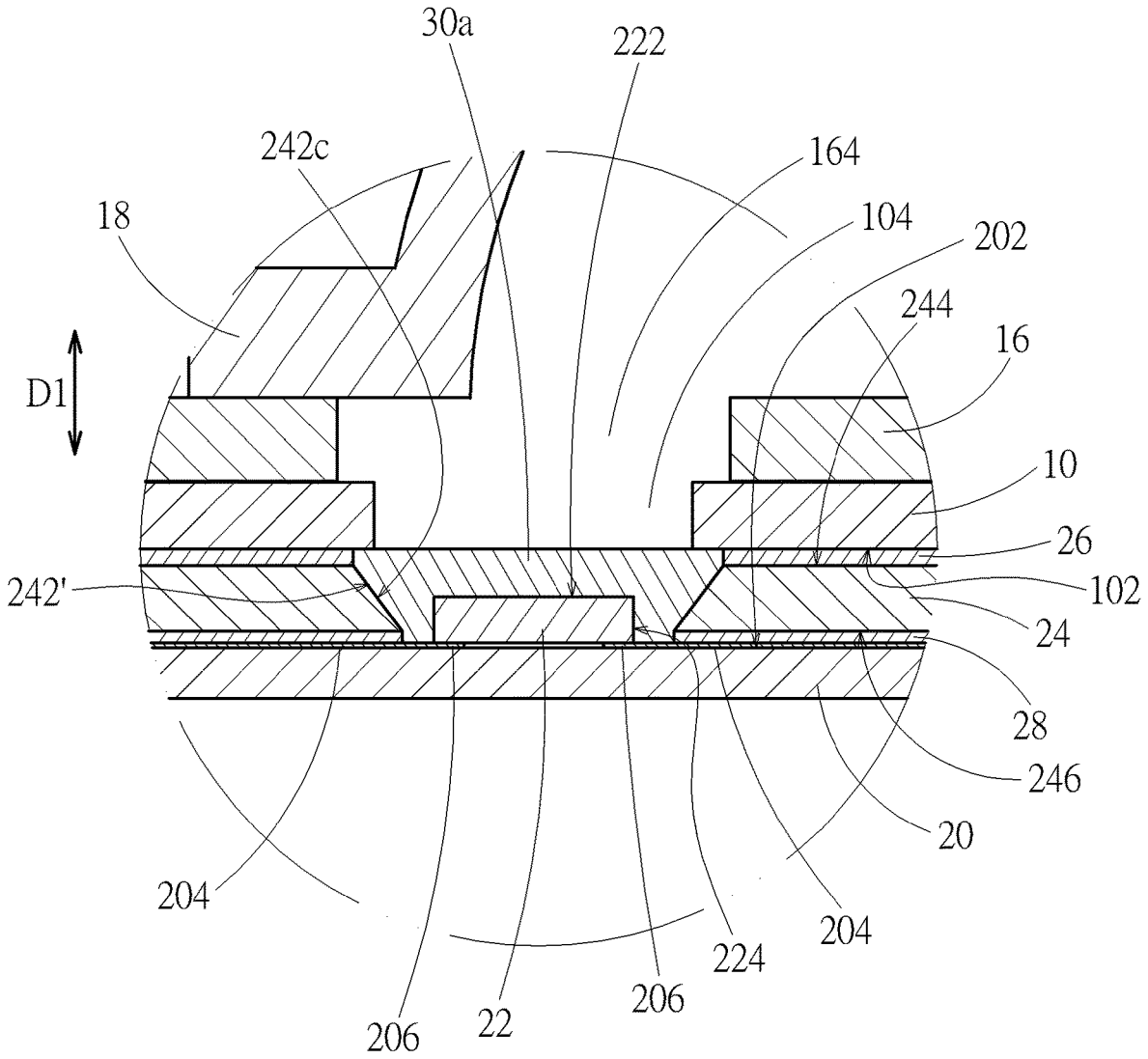
FIG. 7 is a sectional view of the through hole of the spacer in another instance.
Figure 8:
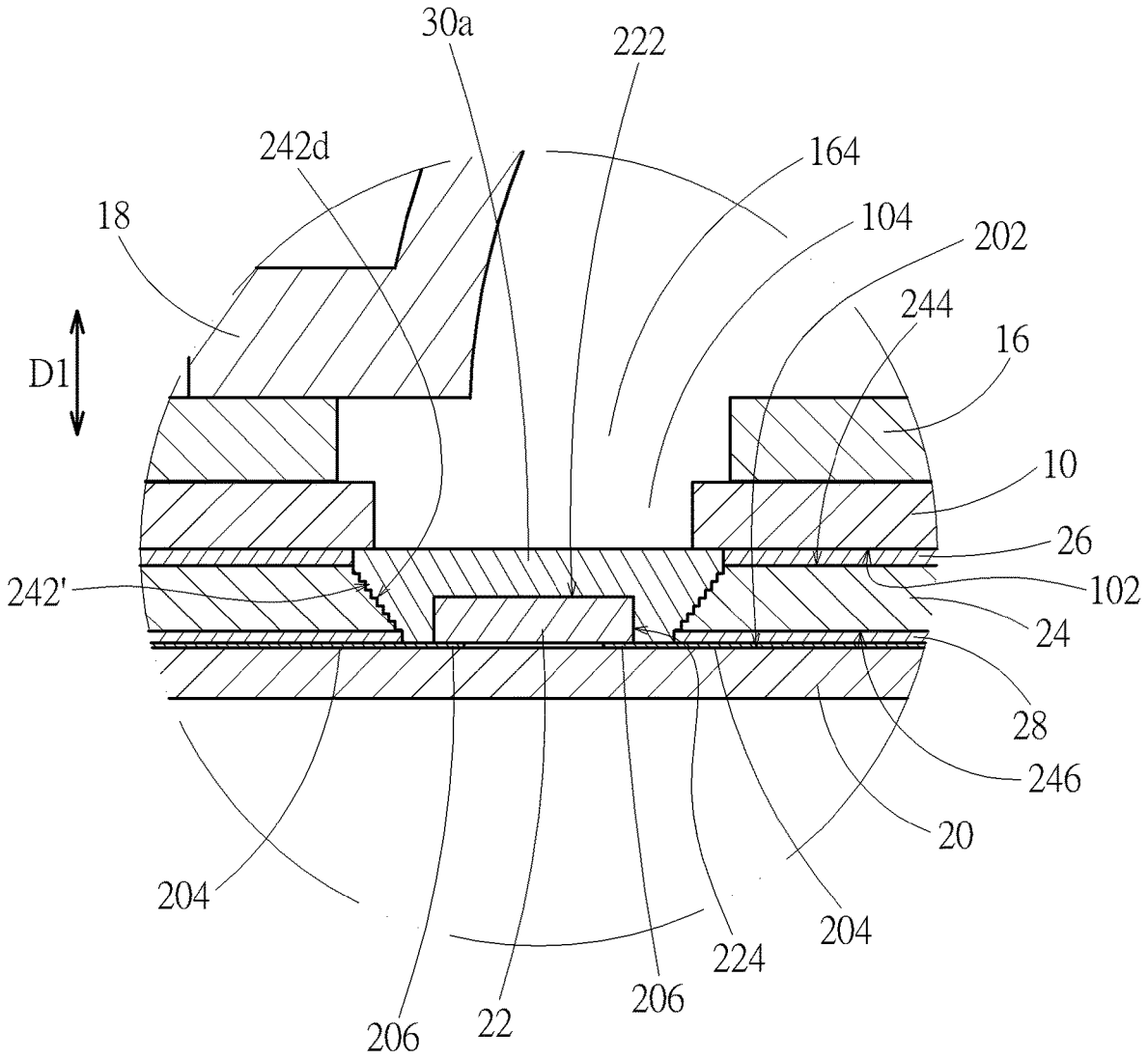
FIG. 8 is a sectional view of the through hole of the spacer in another instance.
Figure 9:
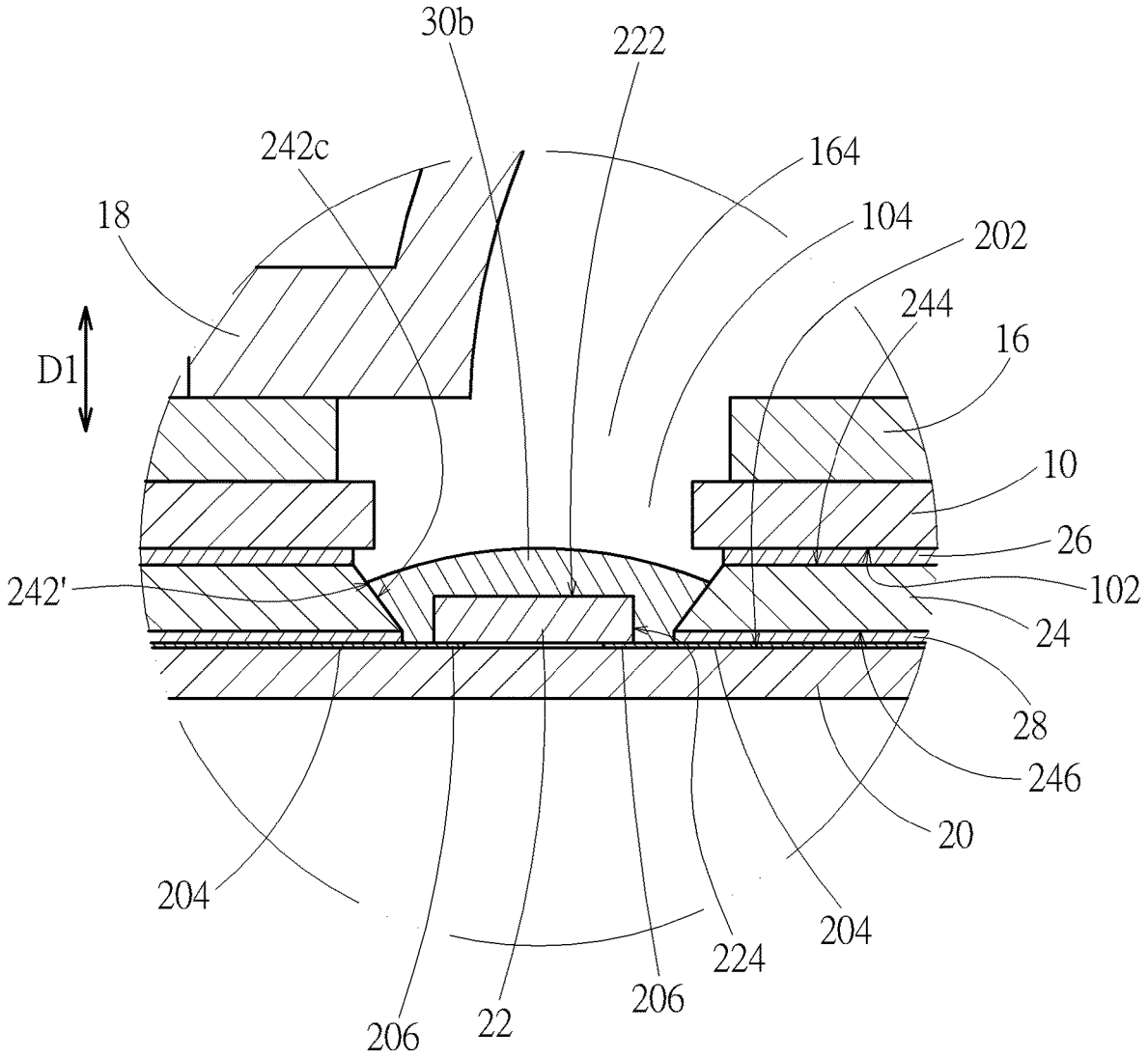
FIG. 9 is a sectional view of the light-permeable covering structure in the through hole of the spacer in an instance.
Figure 10:
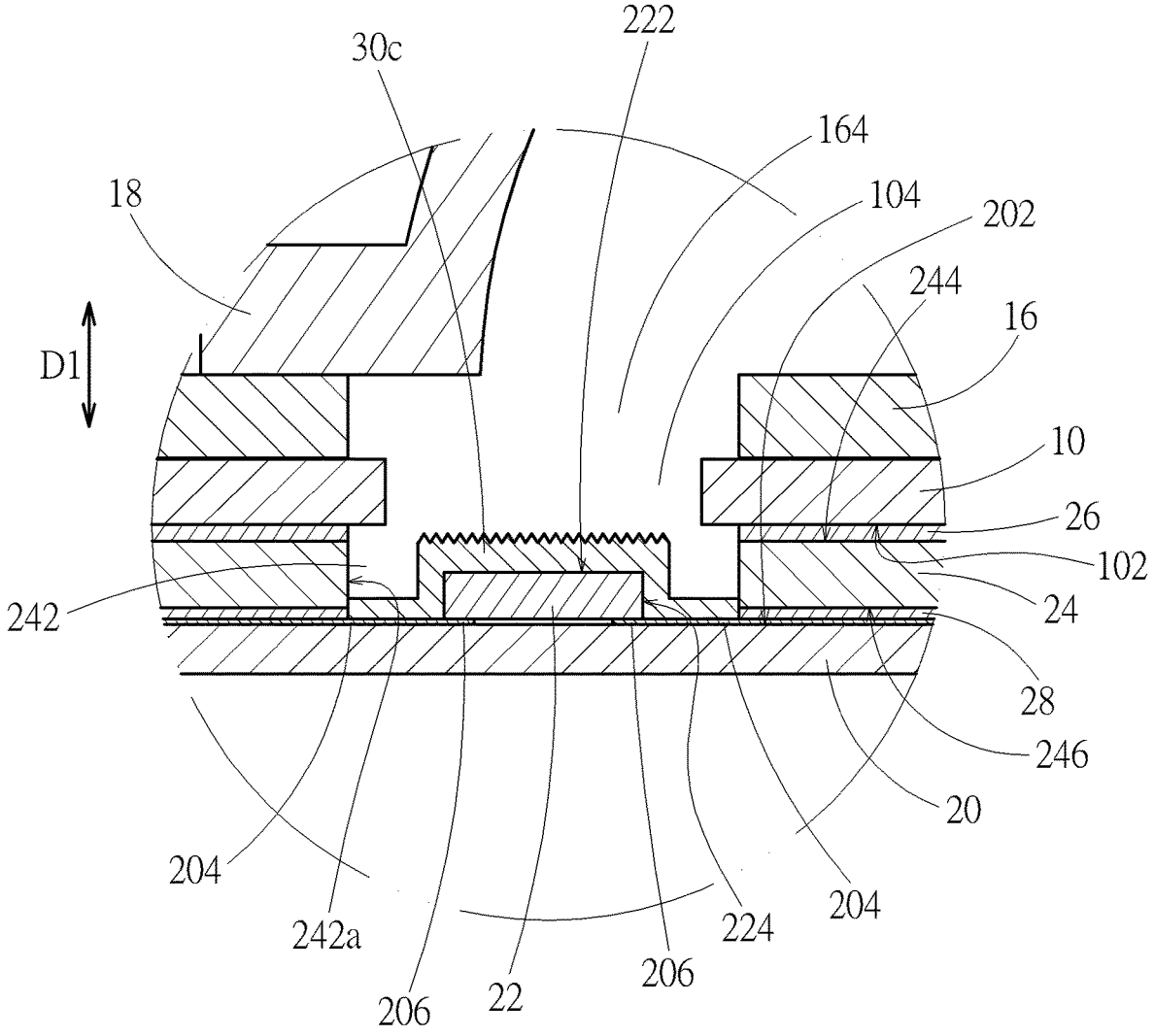
FIG. 10 is a sectional view of the light-permeable covering structure in the through hole of the spacer in another instance.

Furthermore, in the embodiment, the light-permeable covering structure 30 does not completely fill up the through hole 242, and there is a gap formed between the light-permeable covering structure 30 and the sidewall 242*a* of the through hole 242. As shown by FIG. 3, an air separation wall is formed between the light-permeable covering structure 30 and the sidewall 242*a* of the through hole 242 and surrounds the side surface 224; however, it is not limited thereto. For example, in an instance shown by FIG. 6, the sidewall 242*b* of the through hole 242' can reflect light and is a cup-shaped structure with an opening facing upward (i.e., toward the opening 104 of the base plate 10), which helps to direct the light emitted by the light-emitting part 22 to travel upward. In the embodiment, the sidewall 242*b* as a whole is a concave surface. However, it is not limited thereto in practice. For example, the sidewall 242*c* is a tapered surface (as shown by FIG. 7). For another example, the sidewall 242*d* is a stepped surface (as shown by FIG. 8). For another example, the sidewall may be other structures capable of directing light upward. The above concave surface, tapered surface, and stepped surface may be formed by hot pressing in practice. Furthermore, as shown by FIG. 6, the light-permeable covering structure 30*a* fills up the through hole 242' and is substantially coplanar with the bottom surface 102 of the base plate 10; however, it is not limited thereto in practice. For example, the light-permeable covering structure 30*b* has an upward protrusion (as shown by FIG. 9). For another example, the surface of the light-permeable covering structure 30*c* is provided with a micro structure formed thereon (e.g. a serrated structure, as shown by FIG. 10). Similarly, the above light-permeable covering structure 30*a* and light-permeable covering structure 30*b* may be a multi-layer structure in practice, which will not be repeated. In practice, the contours of the light-permeable covering structure 30*a* and light-permeable covering structure 30*b* may be formed by hot pressing. For the protection effect on the light-emitting part 22, the total thickness of the spacer 24, the top adhesive 26(26'), and the bottom adhesive 28(28'), or the sum of the height of the sidewall 242*a* of the through hole 242 and the thicknesses of the top adhesive 26(26') and the bottom adhesive 28(28') is required to be greater than or equal to the sum of the height of the light-emitting part 22 and the thickness of the portion of the light-permeable covering structure 30 (or the light-permeable covering structures 30*a* and 30*b*) above the light-emitting part 22.

In addition, as shown by FIG. 1 to FIG. 3, in the illuminated keyswitch structure 1, the resilient restoration part 18 is light-transmissive, so that even if the light-emitting part 22 is under the resilient restoration part 18, the light emitted by the light-emitting part 22 still can travel toward the keycap 12 to provide back light required for a light-transmissive portion of the keycap (indicated by a dashed frame in FIG. 1 and FIG. 2; e.g. numbers, symbols, letters, text, graphics or a combination thereof). Furthermore, in the embodiment, the light-emitting part 22 emits light from the top surface 222; however, it is not limited thereto in practice. For example, the light-emitting part 22 may be side-emitting and still can effectively guide the light emitted by the light-emitting part 22 to travel toward the keycap 12 in coordination with a cup-shaped through hole sidewall (e.g. the sidewalls 242*b*~*d*).

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An illuminated keyswitch structure, comprising:

a base plate, including at least one opening;

a drive circuit board, disposed under the base plate;

a spacer, disposed onto the drive circuit board, the spacer having an upper surface, a lower surface, a through hole and a sidewall defining the through hole;

a light-emitting part, disposed on the drive circuit board and in the through hole of the spacer, the light-emitting part having a top surface lower than or equal to the upper surface of the spacer; and a light-permeable covering structure covering above the light-emitting part;

wherein the spacer comprises a top adhesive and a bottom adhesive respectively disposed on the upper surface and the lower surface of the spacer;

wherein a total thickness of the spacer, the top adhesive, and the bottom adhesive is greater than or equal to a sum of a height of the light-emitting part and a thickness of a portion of the light-permeable covering structure above the light-emitting part.

2. The illuminated keyswitch structure according to claim 1, further comprising a switch circuit board, disposed in parallel to the base plate, wherein the switch circuit board has a light-permeable portion overlapping a vertical projection of the opening of the base plate.

3. An illuminating module for providing back light from underneath an opening of a keyswitch base plate, the illuminating module comprising:

a drive circuit board;

a spacer, disposed onto the drive circuit board, the spacer having an upper surface, a lower surface, a through hole and a sidewall defining the through hole;

a light-emitting part, disposed on the drive circuit board and in the through hole of the spacer, the light-emitting part having a top surface lower than or equal to the upper surface of the spacer; and a light-permeable covering structure covering above the light-emitting part;

wherein the spacer comprises a top adhesive and a bottom adhesive respectively disposed on the upper surface and the lower surface of the spacer;

wherein the upper surface or the lower surface has an annular clearance fringe without the top adhesive or the bottom adhesive respectively, and the annular clearance fringe surrounds a periphery of the through hole.

4. The illuminating module according to claim 3, wherein the annular clearance fringe of the top adhesive or the bottom adhesive surrounds a vertical projection of the light-permeable covering structure and/or the light-emitting part.

5. The illuminating module according to claim 3, wherein a vertical projection of the light-permeable covering structure locates inside the annular clearance fringe of the top adhesive or the bottom adhesive.

6. The illuminating module according to claim 3, wherein the annular clearance fringe of the top adhesive or the bottom adhesive surrounds a vertical projection of the opening of the base plate.

7. The illuminating module according to claim 3, wherein the light-emitting part has a top surface and a side surface, and the light-permeable covering structure covers the top surface and the side surface.

8. The illuminating module according to claim 7, wherein an air separation wall is formed between the light-permeable covering structure and the sidewall of the through hole.

9. The illuminating module according to claim 3, wherein the light-permeable covering structure contacts at least a portion of the drive circuit board and/or the sidewall of the spacer.

10. The illuminating module according to claim 3, wherein the light-permeable covering structure comprises a first covering layer and a second covering layer, the first covering layer is disposed above the light-emitting part, and the second covering layer is disposed on the first covering layer.

11. The illuminating module according to claim 10, wherein the first covering layer or the second covering layer is an optical wavelength conversion layer.

12. The illuminating module according to claim 3, wherein the light-permeable covering structure comprises a light modulation portion on top of the light-emitting part.

13. The illuminating module according to claim 3, wherein the light-permeable covering structure is lower than or equal to the bottom surface of the base plate.

14. The illuminating module according to claim 3, wherein the sidewall of the through hole reflects light and is a cup-shaped structure with a cup opening facing the opening of the keyswitch baseplate.

15. The illuminating module according to claim 3, wherein the sidewall of the through hole is a tapered surface, a concave surface, or a stepped surface.

16. The illuminating module according to claim 3, wherein the spacer is opaque.

17. The illuminating module according to claim 3, wherein the spacer is light-transmissive, and the sidewall of the spacer is opaque.

18. The illuminating module according to claim 3, wherein the spacer is light-transmissive.

19. The illuminating module according to claim 3, wherein the light-emitting part emits light from the top surface.

20. An illuminating module for providing back light from underneath an opening of a keyswitch base plate, the illuminating module comprising:

a drive circuit board;

a spacer, disposed onto the drive circuit board, the spacer having an upper surface, a lower surface, a through hole and a sidewall defining the through hole;

a light-emitting part, disposed on the drive circuit board and in the through hole of the spacer, the light-emitting part having a top surface lower than or equal to the upper surface of the spacer; and a light-permeable covering structure covering above the light-emitting part;

wherein the spacer comprises a top adhesive and a bottom adhesive respectively disposed on the upper surface and the lower surface of the spacer;

wherein a sum of a height of the sidewall of the through hole and thicknesses of the top adhesive and the bottom adhesive is greater than or equal to a sum of a height of the light-emitting part and a thickness of a portion of the light-permeable covering structure above the light-emitting part.

* * * * *